United States Patent [19]

Grander

[11] Patent Number: 4,662,640

[45] Date of Patent: May 5, 1987

[54] GOLF SWING TRAINING DEVICE

[75] Inventor: William R. Grander, Somerville, N.J.

[73] Assignee: Feel & Swing Golf Corporation, North Brunswick, N.J.

[21] Appl. No.: 791,806

[22] Filed: Oct. 28, 1985

[51] Int. Cl.[4] ..... A63B 69/36

[52] U.S. Cl. ..... 273/183 B; 273/186 C; 273/191 B

[58] Field of Search ..... 273/188 R, 193 A, 183 B, 273/186 C, 186 A, 191 B, 26 C

[56] References Cited

U.S. PATENT DOCUMENTS

| | | | |
|---|---|---|---|
| 1,524,196 | 1/1925 | Matthews | 273/193 A X |
| 2,893,736 | 7/1959 | Tesi | 273/188 R |
| 3,743,297 | 7/1973 | Dennis | 273/193 A |

FOREIGN PATENT DOCUMENTS

| | | | |
|---|---|---|---|
| 708502 | 4/1965 | Canada | 273/188 R |
| 165960 | 7/1921 | United Kingdom | 273/188 R |

*Primary Examiner*—George J. Marlo
*Attorney, Agent, or Firm*—Sperry, Zoda & Kane

[57] ABSTRACT

Disclosed is a device for training a golfer to make a correct, repetitive swing. The device includes a harness adapted to be adjustably fitted about the shoulders and chest of the user to provide a means from which there depends a resiliently extendable, V-shaped suspending assembly for a training club of the type having a contoured training grip and a shaft of abbreviated length fitted at its lower end with a spherical weight. The V-shaped suspending assembly includes a pair of downwardly converging, elastic straps or suspension cords the upper, divergent ends of which are connected to the harness at widely spaced locations on the wearer's chest. In a preferred embodiment, one of the elastic elements is greater in length than the other, so that the V-shaped suspending assembly is asymmetrical. As a result, both elements are maintained at substantially the same tension in critical areas of the swing. During the swing, the suspension elements are tensioned to varying degrees, thus permitting one to "feel" the extent to which he is adhering to, or perhaps departing from, the several fundamentals of a sound swing.

5 Claims, 11 Drawing Figures

Fig. 3.
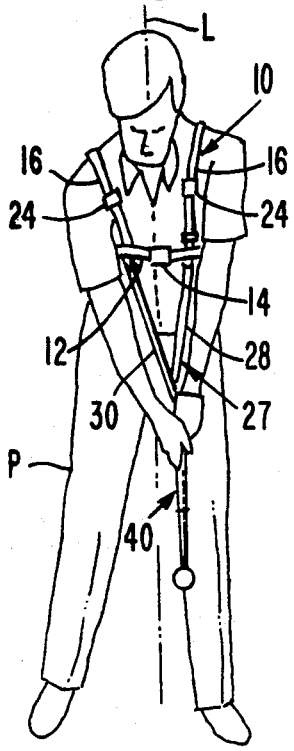
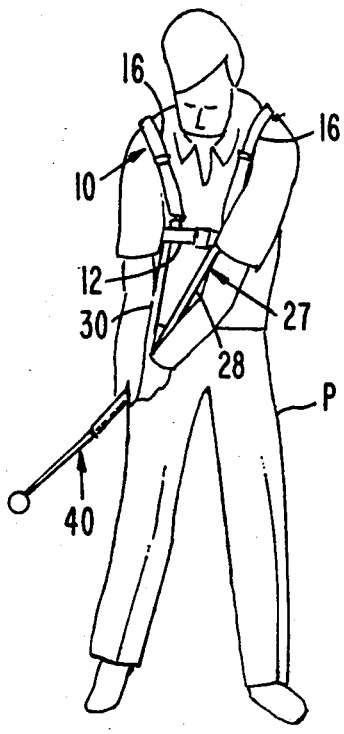
Fig. 4.
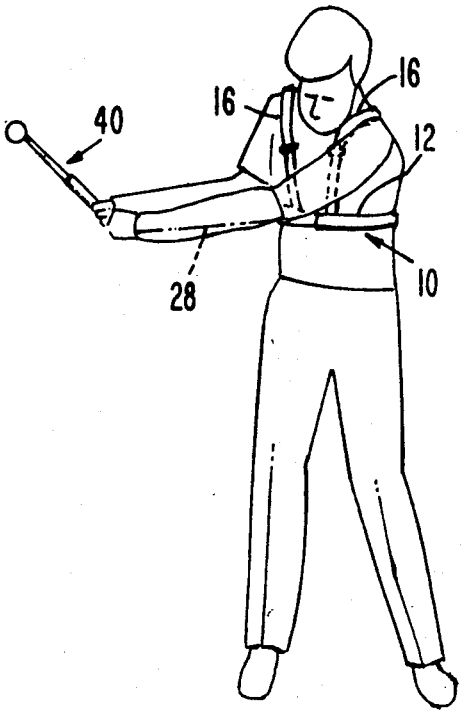
Fig. 5.
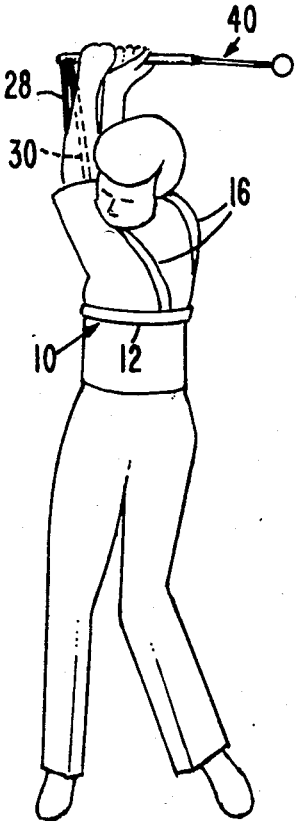
Fig. 6.
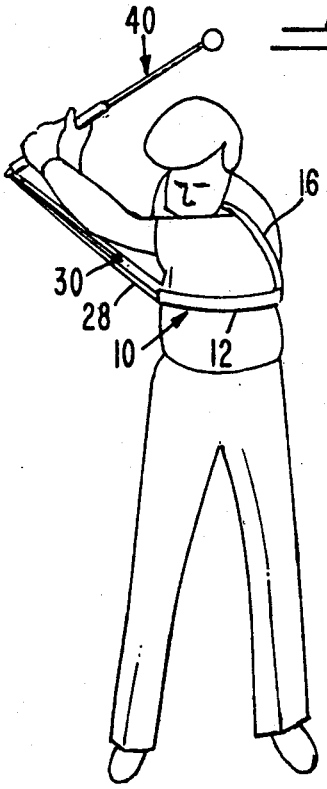
Fig. 7.
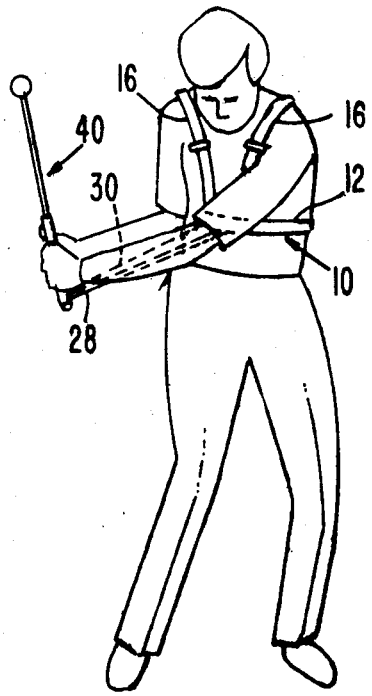
Fig. 8.

GOLF SWING TRAINING DEVICE

BACKGROUND OF THE INVENTION

1. Field of the Invention

The present invention relates generally to the field of devices for training novices, or retraining experienced players, in the basic fundamentals of a sound and correct golf swing. In a more particular sense, the invention relates to a device for this purpose having a flexible, adjustable harness, a club suspension means depending from the harness, and a training club suspended from said means.

2. Background of the Invention

Achieving a sound, repetitive golf swing is an elusive proposition at best, for most golfers. Considerable effort and time has been devoted, over the years, to the development, accordingly, of training devices of various types, for the purpose of aiding both novice and experienced golfers in achieving the desired goal of making a good swing each and every time the golfer addresses the ball for the purpose of putting it into play.

Many of these devices have been unsuccessful. In some instances, the training devices have been extremely complicated, often involving rigid frameworks extending about, in back, and above the golfer. Such devices, in many instances, have erred, it is believed, on the side of doing for the golfer that which the golfer should do for himself; that is to say, devices of the type using rigid frameworks tend to hold the golfer in correct position, or require swinging of the club in a correct plane, without giving the golfer the opportunity to train himself in the correct posture, swing plane, and the several other basic fundamentals required if one is to swing a golf club correctly.

Other devices that have been heretofore conceived in the prior art have been less complicated, utilizing belts or harnesses, but once again, have failed to achieve the hoped-for goal of having a golfer learn the correct fundamentals with a minimum number of constraints, through the provision of a device which will permit the golfer himself to immediately feel departures from the proper fundamentals that must be learned and followed if one is to swing the club correctly.

It has been proposed, for example, heretofore, in devices that do not utilize the principle of an external framework, to provide harnesses or belts which nevertheless include rigidly constituted, projecting guiding loops or the like. It is known, further, to provide means for suspending a golf club from a harness, but in this instance, said means is completely lacking in any suggestion for letting the golfer develop feel for the correct fundamentals, through both arms, from the address and takeaway to and including a good follow-through.

It is also true that in the prior art devices known to the applicant, the training aids have in many instances been designed for the specific purpose of correcting specific swing faults, as for example, the so-called "flying elbow", the prevention of sway, the premature uncocking of the wrists, and others too numerous to mention.

For these and other reasons, most if not all of the prior art golf swing training devices of the type attached to or otherwise contacting the player, have been largely unsuccessful.

It is proposed, accordingly, to overcome the deficiencies in the prior art devices noted above, through the provision of a training device which in the first instance will be of very light and simple construction, and capable of being put on and adjusted to the body of the wearer with minimum difficulty.

It is further proposed that the device comprising the present invention overcome other deficiencies of the prior art as noted above, through the provision of suspending means for a training-type golf club, which suspending means will be specially adapted to impart to the user a feel for correct swing fundamentals, transmitted through both hands and arms, including all of the basic aspects of a golf swing, such as grip, set-up, takeaway, a proper turn, a proper weight shift, and a good follow-through.

It is further proposed to so design the golf training device comprising the present invention as to permit it to be used in training one in the correct fundamentals of all aspects of the game, from putting, chipping, pitching, half and three-quarter swings, on up to the full swing.

It is further proposed to overcome other deficiencies of the prior art through the provision of a device of the character described that will be capable of manufacture at relatively low cost, will offer minimum impedance to the user's movements, and will be of long-lasting and durable construction.

SUMMARY OF THE INVENTION

Summarized briefly, the present invention includes a harness including a pair of adjustable shoulder straps, and a chest strap, also adjustable, that extends about the torso of the player. Secured to the chest strap, at locations transversely spaced across the wearer's torso, are resiliently extensible straps or cords, extending downwardly into converging relation, and connected at the point of convergence to the upper end of a training type golf club. The golf club is known in and of itself, and in a preferred embodiment includes a molded golf training grip, a shaft of abbreviated length, and a spherical weight secured to the lower end of the shaft.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIGS. 3–11 are views showing the device on a player, and illustrating the device and the player at successively following stages of the golf swing, beginning with the set-up or address in FIG. 3 and concluding with the follow-through in FIG. 11, the sequence showing the device and the player during the execution of a full swing.

DESCRIPTION OF THE PREFERRED EMBODIMENT

Figure 1:
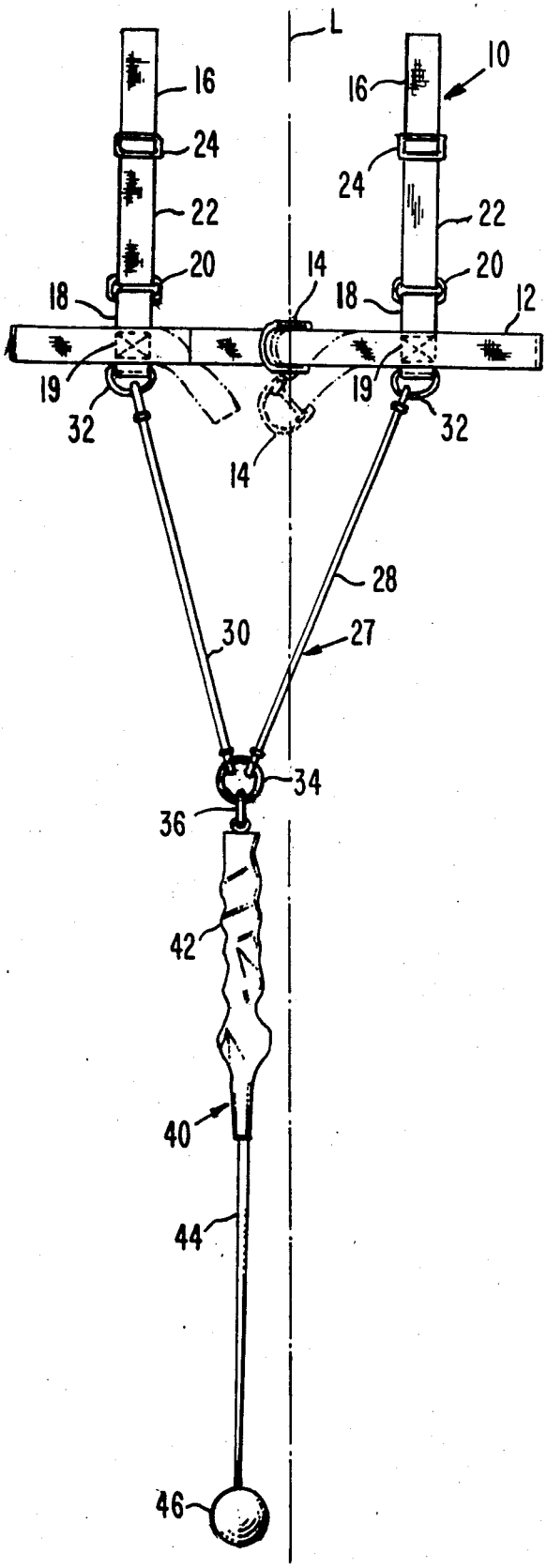
FIG. 1 is a front elevational view of a golf training device formed according to the present invention.

Referring to the drawing in detail, the reference numeral 10 generally designates a golf swing training device according to the present invention. The illustrated device includes a harness essentially comprising, in a preferred embodiment, a chest strap 12, and a pair of shoulder straps 16, 16.

Figure 2:
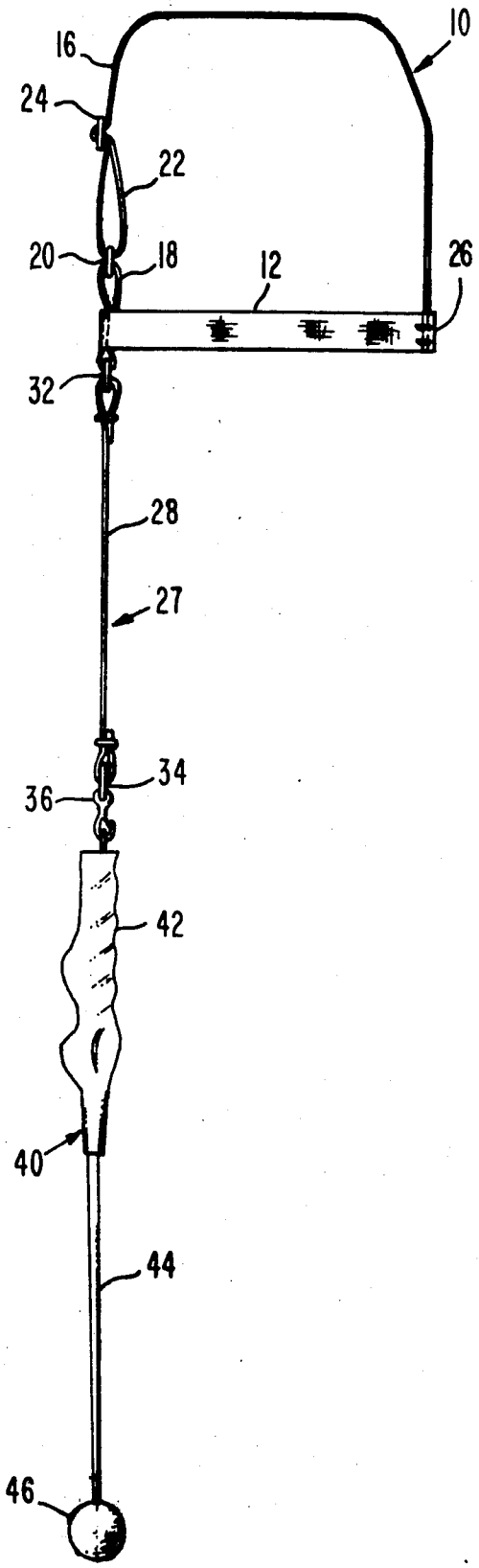
FIG. 2 is a side elevational view thereof as seen from the right of FIG. 1.
Figure 9:
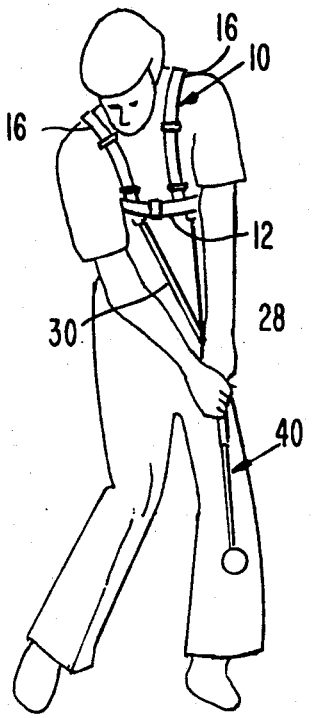
Figure 10:
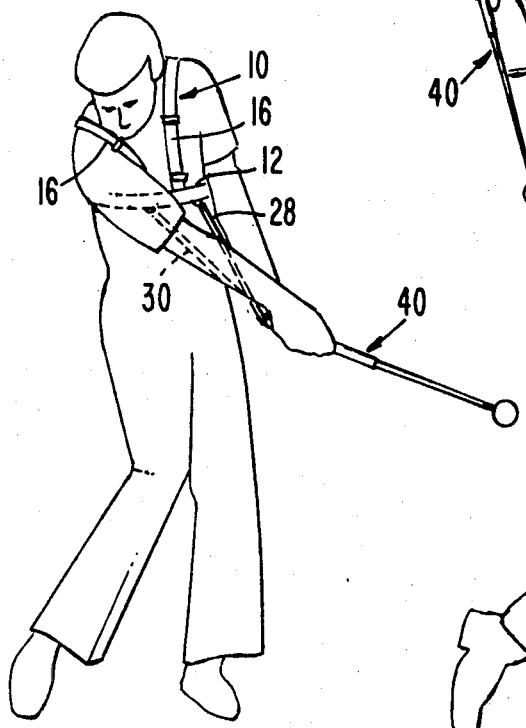
Figure 11:
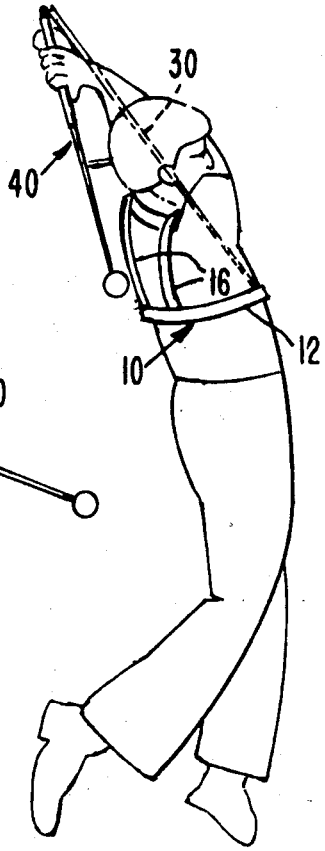

Shoulder straps 16 are individually adjustable as to length, and preferably include connecting loops 18, stitched as at 19 or otherwise permanently secured to the forward portion of the chest strap 12, and providing closed loops (see FIG. 2) receiving a connecting ring 20, which extends also through a loop 22 provided upon the forward portion of each shoulder strap. Loop 22 is adjustable in length through the provision of an adjusting ring 24 which is slidable along the length of the strap 16 to increase or decrease the size of the loop 22, for the purpose of adjusting the overall length of the shoulder strap.

Detailed drawings and explanations of the shoulder strap loops and their associated adjusting and connecting means are not thought necessary, since individually, these features are already known per se and are widely used in trousers suspenders, parachute harnesses, and a wide variety of other items utilizing shoulder straps. It is mainly important, for the purpose of the present invention, to note that the individual shoulder strap 16 can be quickly and readily adjusted in length, by any suitable expedient, to fit snugly over the shoulders of the individual receiving the swing training.

At the back of the harness, the shoulder straps are permanently secured by stitching 26 or other suitable means to the back portion of the chest strap 12.

Chest strap 12 is also adjustable about the chest of the wearer, through the provision of a conventional adjustable belt buckle 14. Again, this is a conventional device per se, and special illustration thereof is not required. Indeed, as is true of the shoulder straps, the chest strap can be adjusted in length by any of a wide variety of known expedients used in adjusting the length of shoulder straps and belts.

Extending downwardly from the chest strap, is a V-shaped golf club suspension means generally designated 27, essentially comprising a pair of downwardly converging, resiliently extensible straps or cords 28, 30.

At this point, it may be noted from FIGS. 1–11 that the device as illustrated is worn by a right-handed golfer. The invention can, of course, be utilized in the training of left-handed golfers. Accordingly, hereinafter, suspension element 28 will be referred to as the "front" element, while suspension element 30 will be referred to as the "rear" element. The front and rear elements 28, 30 would be at the left and right sides of a right-handed golfer, respectively, and the converse would be true for a left-handed player.

The front suspension element 28, as noted from FIG. 1, is slightly longer in length than element 30, in the untensioned condition of the respective elements. Accordingly the V defined by the downwardly converging elements 28, 30 is asymmetrical, with the point of convergence being located rearwardly of an imaginary line L vertically, symmetrically bisecting the harness 10 and the body of the wearer when the device is in its initial position with the player assuming the address or set-up position as shown in FIG. 3.

In a preferred embodiment, the suspension elements 28, 30 would be strong, woven, rubberized, longitudinally extensible, highly flexible cords or thin ropes such as those commonly called "bungee" cords.

Any suitable means may be employed to connect the upper, divergent ends of the suspension elements 28, 30 to the chest strap 12. Preferably, loops 18 are extended downwardly below the chest strap, and are provided with depending D-rings 32 extended through closed loops provided upon the upper ends of the suspension elements. The lower ends of the suspension elements are also provided with closed loops, through which there extends a single D-ring 34, connected to the upper end of a snap clasp 36, which in turn is adapted to removably receive a screw eye 38 secured to the butt end of a training-type golf club 40.

The training club 40 is known, per se, and includes a training grip 42 which is specially contoured to require that the fingers of the player's hands be positioned properly upon the club when one grips the club and takes his stance. Since the training grip is an old and well known expedient, further detailed description of the particular locations of the finger grooves, etc., is not thought necessary. It is sufficient to note that a training grip of this type is illegal for regular play, but has found wide acceptance as a means for teaching one to assume and learn by repetition, the correct way to hold a golf club.

Extending downwardly from the training grip is a shaft 44 of abbreviated length, that is to say, the shaft is distinctly shorter than one that would be used in a golf club employed for regular play. At the lower end of the shaft, there is provided a spherical weight 46, which tends to impart to the abbreviated training club the weight and balance of a full size, conventional golf club.

OPERATION

In use, the harness is adjustably fitted to the body of a player P, by taking up (or extending, as the case may be) the length of the shoulder straps and chest strap. With the chest and shoulder straps snugly fitted about the wearer's upper body, and with the player assuming the address or set-up position shown in FIG. 3, the suspension elements 28, 30 are taut, though not excessively so. Preferably, they are, at this time, both tensioned slightly, and to an approximately equal extent.

It is important to note, in this regard, that said elements extend in close proximity to and in general parallelism with the arms of the player, along the insides of the arms. Initially, the device might well be used in the presence and under the tutelage of a golf professional or other qualified instructor. Thereafter, however, one purchasing the device can practice and train or retrain himself in its proper use. Or, even initially, with the aid of suitably clear printed instructions, one can learn the proper use of the training device, in a manner calculated to obtain the best results therefrom.

In any event, as seen in FIG. 3, one assumes the set-up or address position known to produce a sound golf swing. When one assumes the correct position shown in FIG. 3, both elements 28, 30 are placed under approximately equal tension. This condition can be observed visually by the user, and in addition, the user feels distinctly the slight but substantially equal tautness of the respective suspension elements, as transmitted from the hands to the transversely spaced locations at which said elements are connected to the chest strap 12.

Should one position his hands too far forwardly, excessive tension is created in the shorter rear strap 30. Conversely, should one position his hands rearwardly to an excessive degree, as for example upon the line L or even to the rear thereof, added tension would be imparted to the front strap, while the rear strap would lose tension. Accordingly, the device automatically positions the hands correctly for the address or set-up position shown in FIG. 3.

As the player takes the club back in the takeaway shown in FIG. 4, he is taught to do so slowly, a fundamental which is universally accepted as being essential for developing a sound golf swing. In doing so, he feels approximately equal tension in both elements and thus notes that he is making a good takeaway, at a proper speed and along a proper path. This is so because the rear element 30 has less distance to travel than does the front element (note FIGS. 4 and 5).

Should the player tend to throw his hands outwardly, that is, away from the body to an excessive degree (an undesirable swing habit known as taking the club back outside), again he feels the error through the suspension elements 28, 30. In these circumstances, as the player takes the club back too far outside a correct swing plane, far too much tension is created upon the suspension elements and is transmitted to the chest strap, than should be present at this state of the swing.

Continuing, when the player's hands on the backswing are approximately waist or chest high, the elements 28, 30 are still under substantially equal tension, if the backswing is proceeding correctly. It may be noted that they remain under substantially equal tension to a location a little above the waist-high position shown in FIG. 5.

Just above the waist, the rear suspension element 30 is distinctly felt by the user as losing tension, if he or she is correctly adhering to sound swing fundamentals. If, however, the player is taking the club back incorrectly, the rear element will lose tension on the backswing at some point prior to a location slightly above the waist. Thus, one can immediately note in what area of the swing there is a breakdown.

There is, for example, a tendency among many golfers to "pick up" the club immediately upon the takeaway, rather than taking the club back in an approved practice known as "taking the club back low and slow". Should one "pick up" the club, the suspension elements, and especially the rear element 30, will lose tension immediately.

It follows that by repetitious use of the training device, either under the careful observation of a trained professional or by careful adherence to written instructions, one can feel the amount of relative tension of the elements 28, 30 that should be present at each and every part of the golf swing, if the swing is made at the correct tempo, in the correct swing plane and from a proper address position. Thus, as seen in FIG. 6, at the top of the swing, the forward element 28 would be fully tensioned and feel would be transmitted through the "front" arm of the wearer, which feel would be more and more distinct if one keeps the "front" arm as straight as possible, makes a good, full shoulder turn away from the ball, and completes the backswing with the hands as high as possible, in the position shown in FIG. 6. The greater the tension of the front element 28 under these circumstances, the more the player knows that he or she has completed a good backswing. It is known, of course, that the downswing shown in FIGS. 7–11 will only be made correctly if one has made a good, correct backswing, that is, the soundness of the backswing determines and controls the effectiveness of the downswing.

In the training exercise, the player now proceeds into the downswing, and as shown in FIG. 7, the front arm of the player remains completely straight or at least nearly so, while the front element 28 also remains under strong tension, though gradually, progressively losing tension as the downswing proceeds. In a training exercise, this is done relatively slowly, so that one can at all times feel the relative tensions between the elements 28, 30 at all stages of the swing.

Of great significance, in this regard, is that both of the suspension elements remain in line with the arms of the player throughout the backswing. By visually noting whether they are in line, the player can in turn determine whether the arms have remained in a proper swing plane, and have been otherwise correctly used, throughout the backswing portion of the golf swing.

In this way, one achieves a complete picture of the golf swing, and is trained in making a repetitive, correct swing, without hitting a ball. The device can thus be used in the home, daily or at least at regular, frequent intervals, over and over again, with the player learning exactly what the relative feel of the tensile suspension elements should be, at all stages of the swing from the address to the follow-through. As noted above, he begins at the address position with both elements feeling equally taut, and if this feel is not transmitted, then it establishes that the player's hands are not correctly positioned to begin the swing. As the swing proceeds first through the backswing and then through the downswing, the relative tension of the suspension elements changes, and the player feels this through the arms, with the suspension elements extending along both arms throughout the swing. The extent to which this tension develops in one or the other of the suspension elements, or lessens in one or the other of said elements at different stages of the swing, determines whether or not the swing is being made correctly.

Of great importance is the fact that the device is not only used for a full swing such as shown by way of example in the drawings, but also is used for all aspects of one's golf game, that is, putting, chipping, pitching, iron shots, approaches, and shots made with the woods. Indeed, the preferred mode of use of the device is to first educate the player in chipping and putting. For example, the first stroke that the player should learn, utilizing the device, is the putting stroke. By watching the "V" defined by the suspension means 27, one determines whether he is making a solid putting stroke. The putting stroke does not, of course, require that one take his or her arms back very far, but they should be taken straight back from the ball, and preferably, should both be kept perfectly straight. Golf as played by skilled players today usually involves a putting stroke which is a so-called "arm and shoulder" stroke, without breaking down of one's wrists. This reduces the number of breakdown points at which a putting stroke might go awry as compared to a putting stroke in which one not only swings the arms and shoulders, but also breaks or collapses the wrists. Utilizing the device comprising the present invention, one learns to putt and chip with the arms kept straight, with no or only minimal wrist break. Again, this is done by feel transmitted through the suspension elements, and also by visual observation thereof during the making of a sound putting or chipping stroke.

Thereafter, one proceeds in learning to use the device through various other types of increasingly longer swings, as for example, a half swing used in short approach shots, a three-quarter swing, and finally full swings made with the irons or woods.

It is known that the average person, whether the person is a novice or an experienced golfer, often has little idea of the proper habits to learn in putting, chipping, and in the various other golf strokes required for a sound golf game. The present device is designed and has been found to effectively teach good habits, and by repetition, these habits become part of one's muscle memory, and automatically come into play to produce good and sound swings in all aspects of one's golf game. Without the device, one feels only the weight of the club head, but with the device, a feel is imparted through the relative tension of the elements 28, 30, that teaches the individual all of the fundamentals, including grip, set-up, takeaway, a proper turn, a weight shift made at the transition from the backswing to the downswing, and a follow-through.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A device for training a golfer in the fundamentals of the golf swing, comprising:

(a) harness means adapted to be fitted to the golfer's upper body, said harness means including a chest strap extending around the golfer's chest at a location roughly midway between the golfer's shoulder and waist, said means further including shoulder straps connected to the chest straps and limiting the chest strap against movement downwardly from said location;

(b) a club having an upper end provided with a grip and having a weighted lower end; and (c) means for suspending the club from said harness means, including a pair of downwardly convergent, resiliently extensible, flexible element having upper ends connected to said chest strap at connection points approximately equidistant from an imaginary line vertically bisecting the harness means, said connection points being spaced transversely of the chest when the strap is worn and being respectively disposed adjacent the upper portions of the golfer's arms when the golfer's hands are extended about said grip and the golfer has assumed an address position, said elements having lower ends connected to the upper end of the club, said elements being arranged to extend along both arms of the golfer when the golfer grips the club and being thereby adapted to be placed under varying degrees of tension relative to each other at different stages of a golf swing responsively to the positions of the hands and arms and the relative straightness of the arms at different stages beginning with the address position and continuing through the golfer's backswing, downswing, and follow-through, whereby to indicate an adherence to swing fundamentals through visual observation and through feel both with respect to the extent that changes in the relative tension of the elements are developed during the swing, and the stage of the swing at which said changes occur.

2. A golf swing training device as in claim 1 wherein the lower ends of the elements meet at the connection thereof to the club to impart a V-shaped configuration to the suspension means.

3. A golf swing training device as in claim 2 wherein one of said elements, in the untensioned condition of the elements, is visibly shorter in length than the other element whereby to impart a clearly asymmetrical form to the V defined by the elements to an extent effective to distinctly locate the apex of the V, and the club depending therefrom, closer to one of said connection points than to the other.

4. A golf swing training device as in claim 3 wherein the shorter element is the rear element in the sense of the direction in which the club is swung.

5. A golf swing training device as in claim 1 wherein said grip is contoured to require that one's hands and fingers are correctly placed thereon, the connection of said elements to the grip being disposed relative to the contouring of the grip to provide a visual reference for orienting the grip and hence the golfer's hands correctly in respect to said harness means and suspending means when the golfer has assumed the address position preliminary to swinging of the club.

* * * * *

UNITED STATES PATENT AND TRADEMARK OFFICE

CERTIFICATE OF CORRECTION

PATENT NO. : 4,662,640

DATED : May 5, 1987

INVENTOR(S) : William R. Grander

It is certified that error appears in the above-identified patent and that said Letters Patent is hereby corrected as shown below:

On the title page assignee should read

-- (73) Assignee: William R. Grander and Feel & Swing Golf Corporation, North Brunswick, N. J. --.

Signed and Sealed this

Sixteenth Day of February, 1988

*Attest:*

*Attesting Officer*

DONALD J. QUIGG

*Commissioner of Patents and Trademarks*